US009693167B2

(12) United States Patent
Honda et al.

(10) Patent No.: US 9,693,167 B2
(45) Date of Patent: Jun. 27, 2017

(54) LOUDSPEAKER AND MOBILE DEVICE INCORPORATING SAME

(71) Applicant: Panasonic Intellectual Property Management Co., Ltd., Osaka (JP)

(72) Inventors: Kazuki Honda, Osaka (JP); Mitsukazu Kuze, Okayama (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/023,388

(22) PCT Filed: Jul. 3, 2015

(86) PCT No.: PCT/JP2015/003356
§ 371 (c)(1),
(2) Date: Mar. 20, 2016

(87) PCT Pub. No.: WO2016/002230
PCT Pub. Date: Jan. 7, 2016

(65) Prior Publication Data

US 2016/0212513 A1 Jul. 21, 2016

(30) Foreign Application Priority Data

Jul. 4, 2014 (JP) ..... 2014-138803
Aug. 4, 2014 (JP) ..... 2014-158314

(51) Int. Cl.
*H04R 31/00* (2006.01)
*H04R 7/00* (2006.01)
(Continued)

(52) U.S. Cl.
CPC ..... *H04R 31/006* (2013.01); *H04R 1/02* (2013.01); *H04R 1/025* (2013.01); *H04R 7/02* (2013.01);
(Continued)

(58) Field of Classification Search
CPC ... H04R 7/02; H04R 7/04; H04R 7/18; H04R 7/20; H04R 9/06; H04R 9/025; H04R 2231/003; H04R 2307/207
See application file for complete search history.

(56) References Cited

U.S. PATENT DOCUMENTS 4,122,314 A * 10/1978 Matsuda ..... H04R 7/02 181/170
5,418,337 A 5/1995 Schreiber
(Continued)

FOREIGN PATENT DOCUMENTS

JP 56-056095 5/1981
WO 2013/144597 10/2013

OTHER PUBLICATIONS

International Search Report of PCT application No. PCT/JP2015/003356 dated Sep. 29, 2015.
(Continued)

*Primary Examiner* — Matthew Eason
(74) *Attorney, Agent, or Firm* — McDermott Will & Emery LLP

(57) ABSTRACT

A loudspeaker includes a diaphragm, a voice coil body, and a magnetic circuit. The diaphragm has a first side, which is the surface of a recess defined by a thin part and a thick part formed around the thin part. The voice coil body includes a bobbin and a voice coil. The bobbin has a first end connected to the thin part on the first side of the diaphragm and a second end opposite to the first end. The magnetic circuit has an inner part, an outer part, and a magnetic gap. Part of the magnetic circuit including the first side of the inner part is located from the second end of the bobbin into the bobbin, and the first side of the inner part and the first side of the outer part are located in the recess so that the voice coil is located in the magnetic gap.

17 Claims, 12 Drawing Sheets

(51) Int. Cl.

| | |
|---|---|
| ***H04R 7/02*** | (2006.01) |
| ***H04R 7/04*** | (2006.01) |
| ***H04R 9/06*** | (2006.01) |
| ***H04R 1/02*** | (2006.01) |
| ***H04R 7/18*** | (2006.01) |
| ***H04R 9/02*** | (2006.01) |
| *H04R 7/10* | (2006.01) |
| *H04R 7/20* | (2006.01) |
| *H04R 9/04* | (2006.01) |

(52) U.S. Cl.

CPC ..... *H04R 7/04* (2013.01); *H04R 7/18* (2013.01); *H04R 9/025* (2013.01); *H04R 9/06* (2013.01); *H04R 7/10* (2013.01); *H04R 7/20* (2013.01); *H04R 9/04* (2013.01); *H04R 2499/13* (2013.01)

(56) References Cited

U.S. PATENT DOCUMENTS 6,449,376 B1 * 9/2002 Beltran ..... H04R 7/04 381/423
6,757,404 B2 * 6/2004 Takewa ..... H04R 7/12 181/174
2002/0121403 A1 * 9/2002 Sahyoun ..... H04R 7/20 181/157
2002/0146145 A1 10/2002 James et al.
2005/0031153 A1 2/2005 Nguyen et al.
2006/0088184 A1 4/2006 Ohashi et al.
2007/0154056 A1 7/2007 Proni
2007/0165886 A1 * 7/2007 Topliss ..... H04R 5/02 381/152
2011/0211725 A1 * 9/2011 Takewa ..... H04R 7/04 381/413
2011/0299716 A1 * 12/2011 Reckert ..... H04R 7/02 381/398
2013/0064413 A1 * 3/2013 Cazes Bouchet ..... H04R 7/04 381/396
2016/0118032 A1 * 4/2016 Kawka ..... G10K 11/002 181/171
2016/0249137 A1 * 8/2016 Honda ..... H04R 7/04
2016/0277839 A1 9/2016 Shikimachi et al.

OTHER PUBLICATIONS

Non-Final Office Action issued in U.S. Appl. No. 15/023,683, dated Feb. 7, 2017.
Notice of Allowance issued in U.S. Appl. No. 15/023,683 dated Apr. 12, 2017.

* cited by examiner

LOUDSPEAKER AND MOBILE DEVICE INCORPORATING SAME

CROSS-REFERENCE TO RELATED APPLICATIONS

This application is a U.S. national stage application of the PCT International Application No. PCT/JP2015/003356 filed on Jul. 3, 2015, which claims the benefit of foreign priority of Japanese patent applications 2014-138803 filed on Jul. 4, 2014 and 2014-158314 filed on Aug. 4, 2014, the contents all of which are incorporated herein by reference.

TECHNICAL FIELD

The present disclosure relates to a loudspeaker used in audio systems and to a mobile device equipped with the loudspeaker.

BACKGROUND ART

A conventional flat loudspeaker includes a frame, a flat diaphragm, a voice coil body, and a magnetic circuit. The magnetic circuit has a magnetic gap and is connected to the frame. The voice coil body includes a bobbin and a voice coil wound around the bobbin. The bobbin is connected at one end to the flat diaphragm, and the voice coil is located in the magnetic gap.

The flat diaphragm is connected at its outer peripheral end to the frame via an edge. The diaphragm has a plate shape with flat sides (the front side and the rear side).

An example of a conventional technique related to the invention of the present application is shown in Patent Literature 1.

CITATION LIST

Patent Literature

PTL 1: Japanese Unexamined Patent Application Publication No. 56-56095

SUMMARY OF THE INVENTION

The loudspeaker of the present disclosure includes a frame, a diaphragm, a first edge, a second edge, a voice coil body, and a magnetic circuit.

The frame has a hollow.

The diaphragm is located in the hollow of the frame and has a first side and a second side opposite to each other. The first side of the diaphragm is the surface of a recess defined by a thin part and a thick part formed around the thin part.

The first edge connects the outer peripheral end of the diaphragm and the frame.

The second edge also connects the outer peripheral end of the diaphragm and the frame. The second edge is opposite to the first edge with respect to the center in the thickness direction of the thick part.

The voice coil body includes a cylindrical bobbin and a voice coil wound around at least part of the bobbin. The bobbin has a first end connected to the thin part on the first side of the diaphragm and a second end opposite to the first end.

The magnetic circuit has an inner part and an outer part formed around the inner part with a magnetic gap therebetween. Part of the magnetic circuit including the first side of the inner part is located from the second end of the bobbin into the bobbin, and the first side of the inner part and the first side of the outer part are located in the recess so that the voice coil is located in the magnetic gap.

The mobile device of the present disclosure includes a body, a drive part mounted in the body, an amplifier mounted in the body, and the loudspeaker of the present disclosure, which receives the output of the amplifier.

DESCRIPTION OF EMBODIMENT

The conventional loudspeaker requires a thin diaphragm in order to have a thin profile, but thin diaphragms are insufficiently rigid.

Another approach to achieving a thin loudspeaker is to use a bobbin having a short length in the direction of the winding axis of the voice coil and a thin magnetic circuit. This, however, reduces the magnetic flux density in the magnetic gap, and hence, the output sound pressure level of the loudspeaker.

Figure 1:
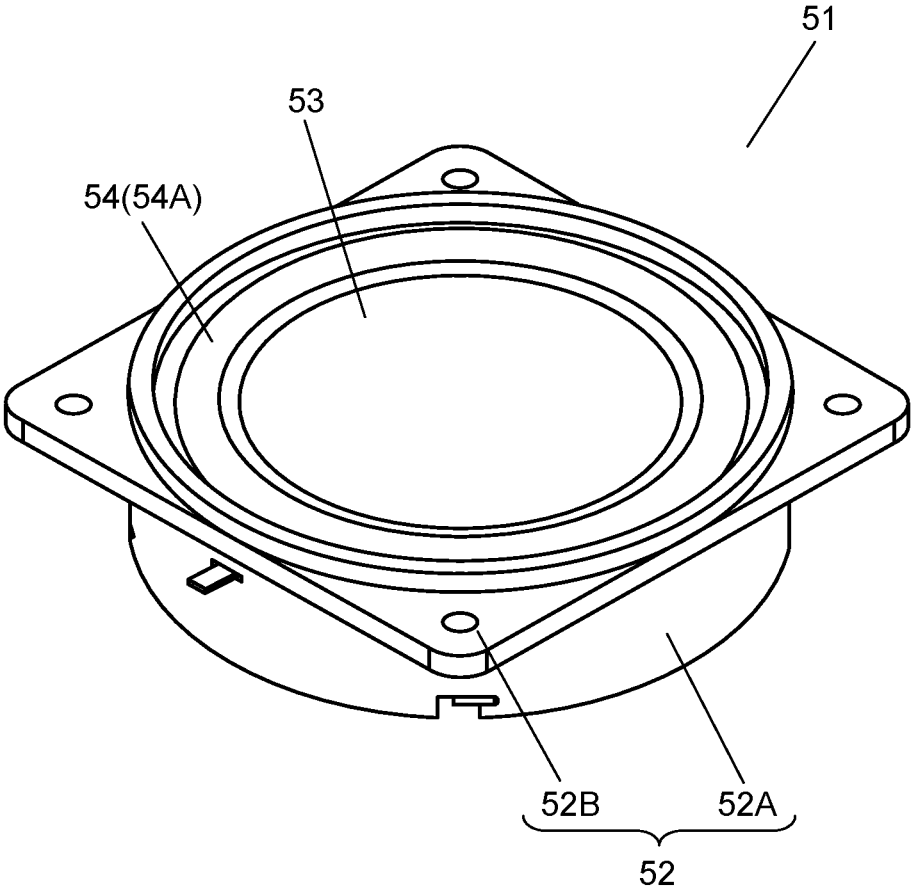
FIG. 1 is a perspective view of a loudspeaker according to a present exemplary embodiment.
Figure 2:
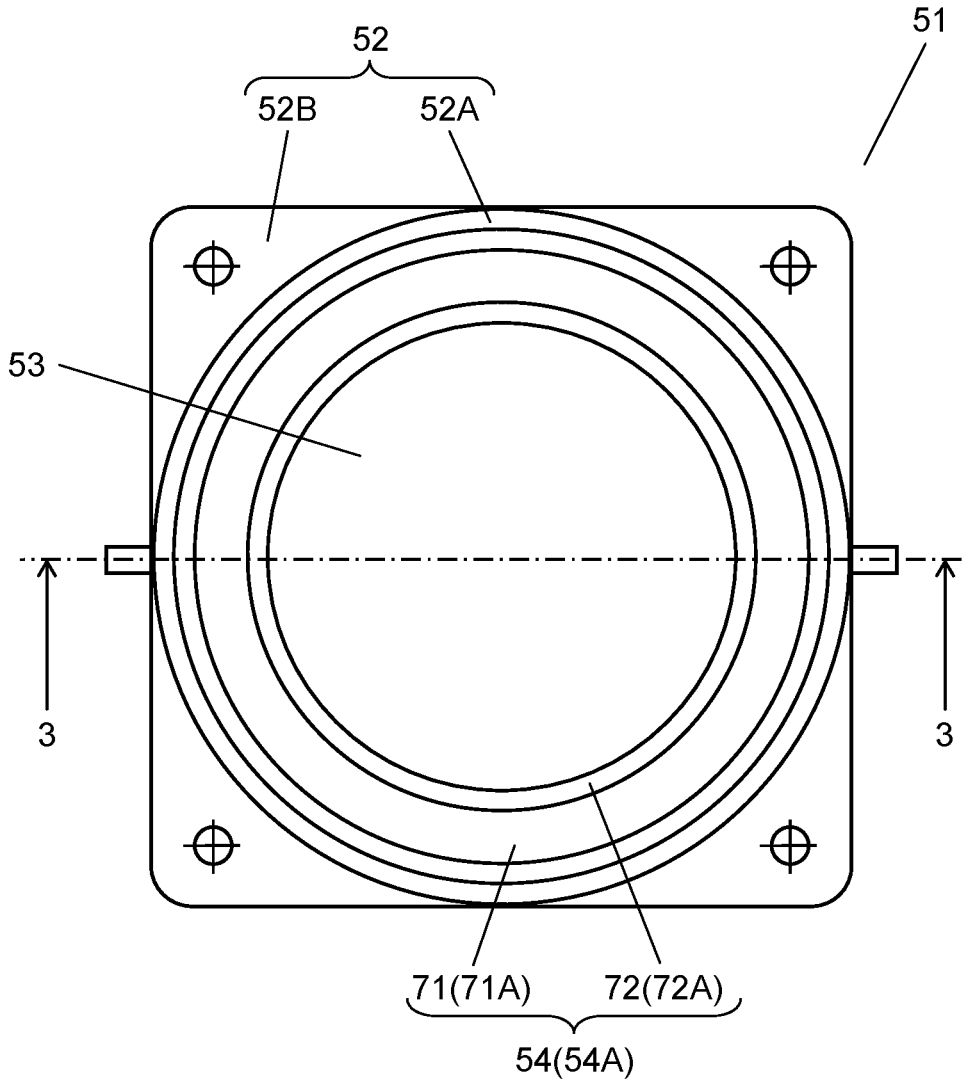
FIG. 2 is a front view of the loudspeaker according to the present exemplary embodiment.
Figure 3:
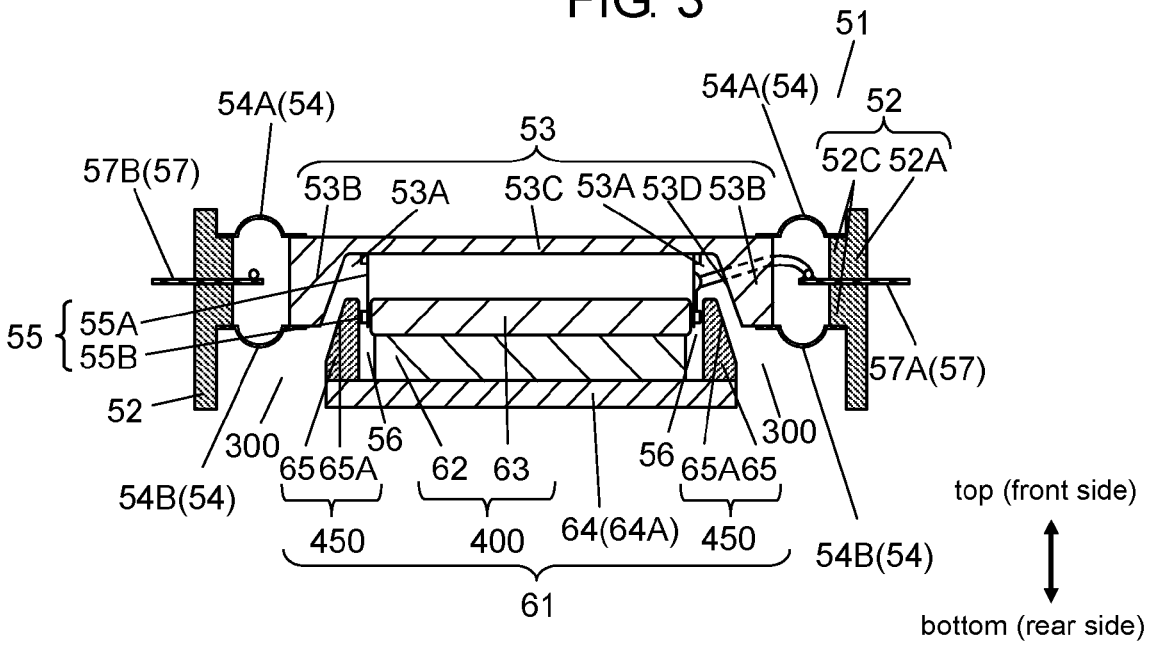
FIG. 3 is a sectional view taken along line 3-3 of FIG. 2.
Figure 4:
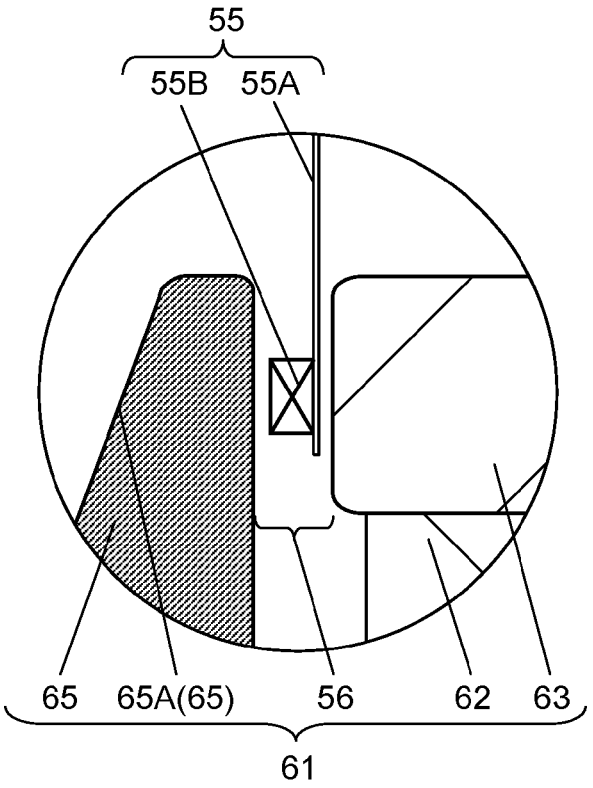
FIG. 4 is an enlarged sectional view of an essential part of a magnetic gap of the loudspeaker according to the present exemplary embodiment.

Loudspeakers come in various shapes depending on the application. For example, in-car loudspeakers need to have a thin profile because they are placed in small spaces such as a dashboard, a door, or a roof. Thin loudspeaker 51 according to the present exemplary embodiment will be described with reference to drawings. FIG. 1 is a perspective view of loudspeaker 51. FIG. 2 is a front view of loudspeaker 51. FIG. 3 is a sectional view taken along line 3-3 of FIG. 2. FIG. 4 is an enlarged sectional view of an essential part of magnetic gap 56 of loudspeaker 51.

Loudspeaker 51 includes frame 52, diaphragm 53, first edge 54A, second edge 54B, voice coil body 55, and magnetic circuit 61.

Frame 52 has hollow 300.

Diaphragm 53 has a first side and a second side opposite to each other and is placed in hollow 300 of frame 52. The first side of diaphragm 53 is the surface of recess 53A defined by thin part 53C and thick part 53B formed around thin part 53C.

First edge 54A connects the outer peripheral end of diaphragm 53 and frame 52.

Second edge 54B also connects the outer peripheral end diaphragm 53 and frame 52. Second edge 54B is opposite to first edge 54A with respect to the center in the thickness direction of thick part 53B.

Voice coil body 55 includes cylindrical bobbin 55A and voice coil 55B wound around at least part of bobbin 55A. Bobbin 55A has a first end connected to thin part 53C on the first side of diaphragm 53, and a second end opposite to the first end.

Magnetic circuit 61 has inner part 400 and outer part 450 formed around inner part 400 with magnetic gap 56 therebetween.

Part of magnetic circuit 61 which includes the first side of inner part 400 (the upper side of FIG. 3) is located from the second end of bobbin 55A into bobbin 55A, and the first side of inner part 400 and the first side of outer part 450 are located in recess 53A, so that voice coil 55B is located in magnetic gap 56.

In FIG. 3, inner part 400 of magnetic circuit 61 is composed of magnet 62 and top plate 63, whereas outer part 450 of magnetic circuit 61 is composed of yoke 65.

Loudspeaker 51 will be described in detail. Magnetic gap 56 is formed on the upper side of magnetic circuit 61 fixed to frame 52 (described later with reference to FIG. 9). The term "upward direction" represents the direction from magnetic circuit 61 toward diaphragm 53, and the term "downward direction" represents the direction from diaphragm 53 toward magnetic circuit 61 in FIG. 3. In FIG. 3, the upward direction is toward the front side of diaphragm 53, and the downward direction is toward the rear side of diaphragm 53.

Diaphragm 53 has thin part 53C and thick part 53B formed around thin part 53C. Thin part 53C and thick part 53B define recess 53A. In other words, thick part 53B is formed on the outer periphery of diaphragm 53. The upper surface of magnetic circuit 61 is located facing thin part 53C.

As shown in FIGS. 3 and 4, voice coil body 55 includes cylindrical bobbin 55A and voice coil 55B wound around at least part of bobbin 55A. The term "cylindrical" here includes rectangular-column shaped. One end of bobbin 55A, or in other words, the first end (front side part) of bobbin 55A, is connected to thin part 53C of recess 53A. Voice coil 55B is wound near the second end (rear side part) of bobbin 55A and is located in magnetic gap 56. When a drive signal is supplied to voice coil 55B, diaphragm 53 vibrates according to the direction and magnitude of the drive signal. Diaphragm 53 is driven in the direction of the winding axis of voice coil 55B (vertical direction in FIG. 3) via bobbin 55A.

As described above, diaphragm 53 has, in the center of its rear side, thin part 53C thinner than thick part 53B, and the upper surface of magnetic circuit 61 is located facing thin part 53C. As a result, the distance can be small between the upper surface of magnetic circuit 61 and the front side of diaphragm 53, allowing the loudspeaker to have a thin profile. Furthermore, thick part 53B formed on the outer periphery of diaphragm 53 increases the strength of diaphragm 53.

Loudspeaker 51 will be described in more detail. As shown in FIG. 1, frame 52 includes base 52A, which is hollow cylinder, and attachment part 52B. Base 52A is preferably cylindrical in the case that diaphragm 53 is circular when seen from the front. Frame 52 does not have to include attachment part 52B, but preferably includes it for the following reason. Attachment part 52B allows loudspeaker 51 to be attached to a baffle board (not shown) or other device. If attachment part 52B has screw holes, loudspeaker 51 can be screwed to the baffle board.

As shown in FIG. 3, loudspeaker 51 preferably includes terminal 57. In the present exemplary embodiment, the term "terminal 57" is used to collectively refer to positive terminal 57A and negative terminal 57B. Terminal 57 is fixed to the lateral side of frame 52.

Figure 5:
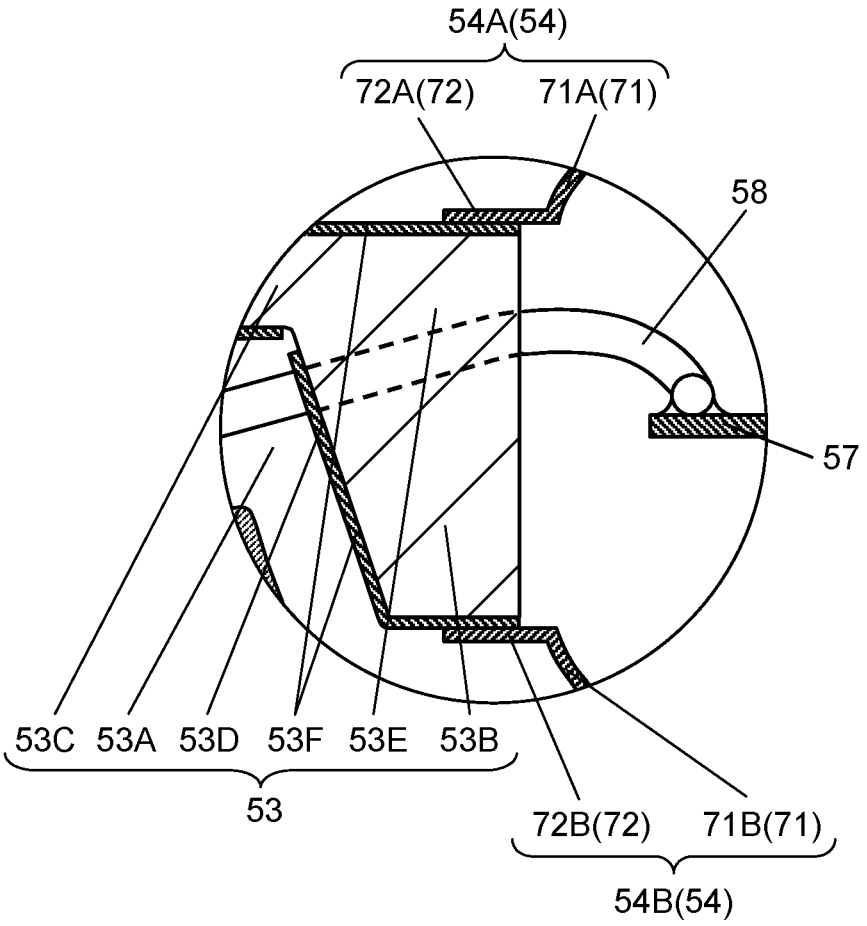
FIG. 5 is an enlarged sectional view of an essential part of an edge of the loudspeaker according to the present exemplary embodiment.

FIG. 5 is an enlarged sectional view of an essential part of edge 54 of loudspeaker 51. In the present exemplary embodiment, the term "edge 54" is used to collectively refer to first edge 54A and second edge 54B. First edge 54A and second edge 54B connect the outer peripheral end of diaphragm 53 and frame 52. Second edge 54B is opposite to first edge 54A in the thickness direction of thick part 53B.

Terminal 57 is located between first edge 54A and second edge 54B in the thickness direction of diaphragm 53 and is connected to connecting wire 58 (tinsel wire). Connecting wire 58 passes through a hole formed in thick part 53B and is led out to the rear side of thin part 53C of diaphragm 53. The start and end points of the wire of voice coil 55B are connected to connecting wire 58 on bobbin 55A. The drive signal to drive loudspeaker 51 is supplied to voice coil 55B through terminal 57 via connecting wire 58.

Frame 52 preferably has affixing part 52C. In the case that frame 52 has affixing part 52C, the outer peripheries of first edge 54A and second edge 54B are affixed to affixing part 52C. To achieve this, affixing part 52C is formed near the end of the front side of base 52A. Affixing part 52C is formed on the inner peripheral surface of base 52A in such a manner as to project toward the center of base 52A. Frame 52 is preferably made of synthetic resin. This configuration allows attachment part 52B and affixing part 52C to be integrally formed with base 52A, thereby having a high production of frame 52.

Affixing part 52C preferably has an upper surface to which the outer periphery of first edge 54A is affixed and a lower surface to which second edge 54B is affixed. As a result, first edge 54A and second edge 54B can be properly connected to frame 52 and have a proper spacing between them, thereby reducing the distortion of loudspeaker 51. Affixing part 52C is not limited to affix first edge 54A and second edge 54B. Alternatively, affixing part 52C may be used to affix either first edge 54A or second edge 54B. Further alternatively, either edges 54A or 54B may be directly affixed to the inner peripheral surface of base 52A.

The outer peripheral end of diaphragm 53 is connected to frame 52 via first edge 54A and second edge 54B. The direction of the vibration (amplitude) of diaphragm 53 (vertical direction of the arrow in FIG. 3) is perpendicular to the direction of the magnetic flux in magnetic gap 56. Thus, diaphragm 53 is displaced in the direction of the winding axis of voice coil 55B by first edge 54A and second edge 54B.

As shown in FIG. 5, first edge 54A includes first rolled part 71A and first joint 72A, whereas second edge 54B includes second rolled part 71B and second joint 72B. First and second joints 72A and 72B are connected to diaphragm 53. In the present exemplary embodiment, first and second rolled parts 71A and 71B are collectively referred to as rolled part 71, whereas first and second joints 72A and 72B are collectively referred to as joint 72.

First edge 54A is located on the front side of diaphragm 53, and second edge 54B is located on the rear side of diaphragm 53. First rolled part 71A preferably projects outward from the center in the thickness direction of diaphragm 53. As a result, first rolled part 71A and second rolled part 71B are prevented from colliding with each other and generating collision noise, regardless of the thickness of diaphragm 53.

First edge 54A and second edge 54B are preferably symmetrically with respect to the plane perpendicular to the direction of the winding axis of voice coil 55B (vertical direction in FIG. 3) or, in other words, perpendicular to the direction of the vibration (amplitude) of diaphragm 53. This configuration allows diaphragm 53 to generate less rolling action, and to cause less distortion due to the asymmetry of the amplitude of diaphragm 53. It is further preferable that first edge 54A and second edge 54B be symmetrically with respect to the center in the thickness direction of diaphragm 53.

It is also preferable to connect first edge 54A with the front side of thick part 53B and to connect second edge 54B with the rear side of thick part 53B. In this case, joint 72 is formed parallel with the front or rear side of diaphragm 53. This configuration can provide a large distance between first edge 54A and second edge 54B, making diaphragm 53 have much less rolling action.

Figure 6:
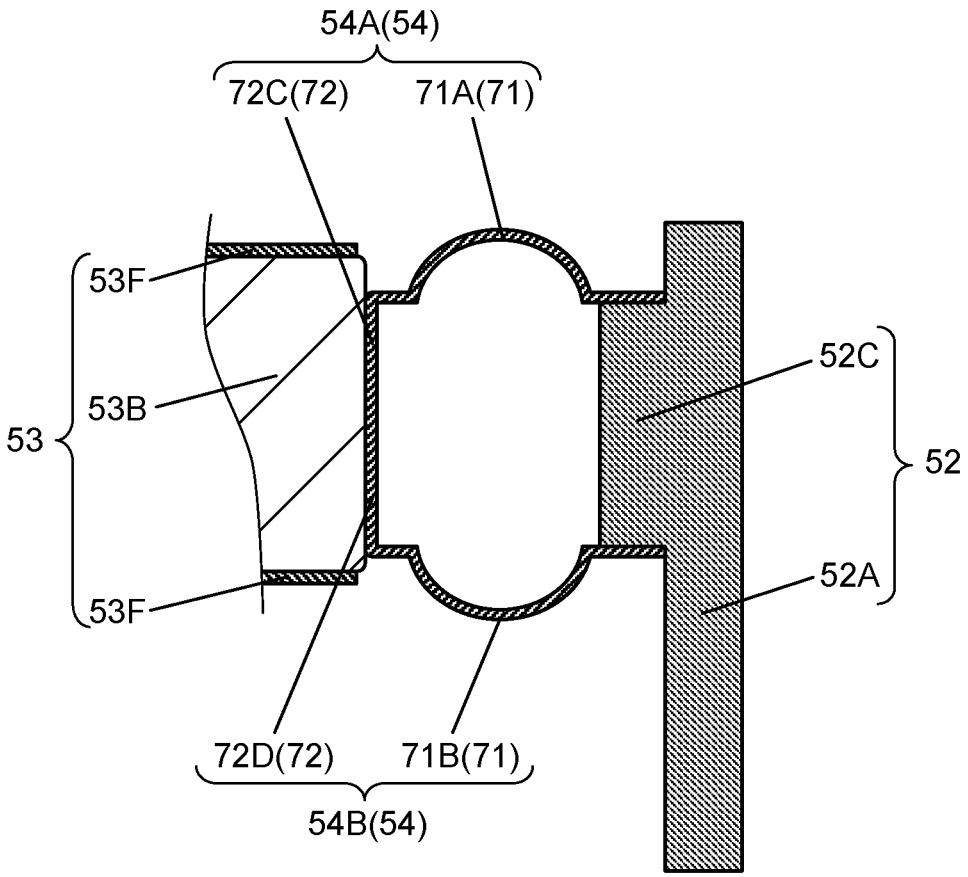
FIG. 6 is an enlarged sectional view of an essential part of another type of edge of the loudspeaker according to the present exemplary embodiment.

FIG. 6 is an enlarged sectional view of an essential part of another type of edge 54 of loudspeaker 51. Joint 72 is connected to the lateral side of diaphragm 53. In FIG. 6, first edge 54A has third joint 72C instead of first joint 72A, whereas second edge 54B has fourth joint 72D instead of second joint 72B. Third joint 72C extends from first rolled part 71A along the lateral side of diaphragm 53, and fourth joint 72D extends from second rolled part 71B along the lateral side of diaphragm 53. Third joint 72C and fourth joint 72D are connected together on the outer peripheral surface of diaphragm 53. It is preferable that first edge 54A and second edge 54B be formed integrally. In other words, it is preferable that third joint 72C and fourth joint 72D be formed connected to each other. This configuration ensures a proper spacing between first edge 54A and second edge 54B and also reduces the man-hours required to connect edge 54 to diaphragm 53.

First edge 54A and diaphragm 53 may alternatively be connected together at a location away from the front-side end on the lateral side of diaphragm 53 toward the rear side, allowing loudspeaker 51 to have a thinner profile. It is alternatively possible to connect either first edge 54A or second edge 54B to the lateral side of diaphragm 53.

Figure 7:
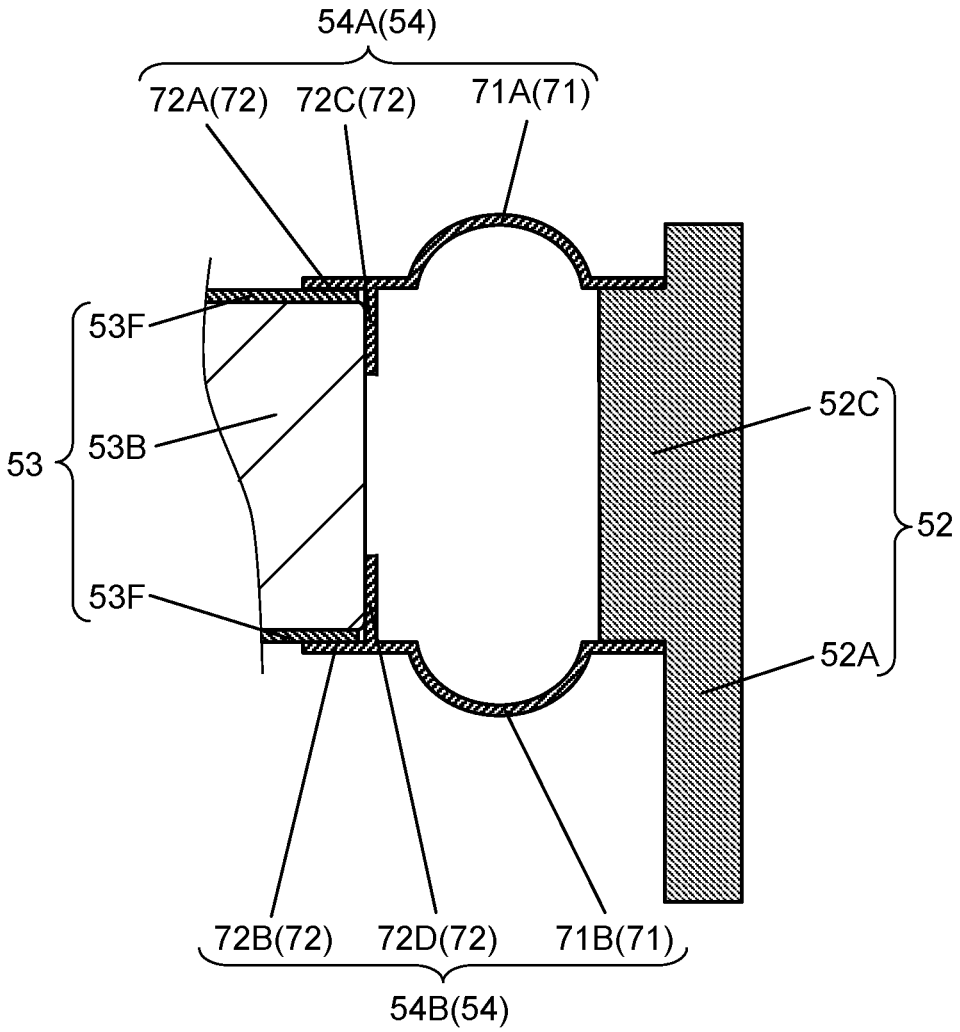
FIG. 7 is an enlarged sectional view of an essential part of still another type of edge of the loudspeaker according to the present exemplary embodiment.

FIG. 7 is an enlarged sectional view of an essential part of still another type of edge 54 of loudspeaker 51. Diaphragm 53 and joint 72 are connected together by still another method. First edge 54A includes first joint 72A and third joint 72C, whereas second edge 54B includes second joint 72B and fourth joint 72D. Thus, first edge 54A is connected both to the front side and to the outer peripheral surface of diaphragm 53, whereas second edge 54B is connected both to the rear side and to the outer peripheral surface of diaphragm 53. With this configuration, edge 54 and diaphragm 53 can be connected in a larger area, and hence, more strongly. As a result, edge 54 is prevented from being detached from diaphragm 53 even if loudspeaker 51 receives a high level signal, thereby improving the input resistance of loudspeaker 51.

Figure 8:
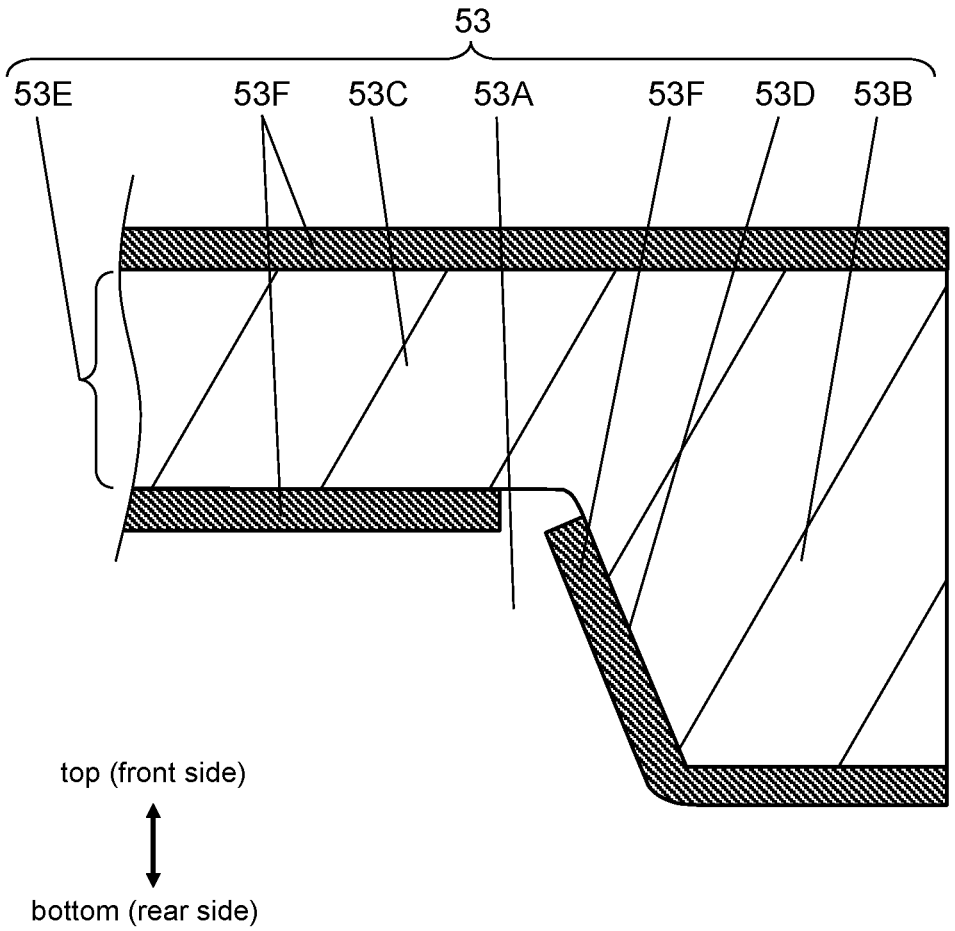
FIG. 8 is an enlarged sectional view of an essential part of a diaphragm of the loudspeaker according to the present exemplary embodiment.

FIG. 8 is an enlarged sectional view of an essential part of diaphragm 53 of loudspeaker 51. Recess 53A has thin part 53C, which is thinner than thick part 53B and preferably has a flat rear side. In thin part 53C, diaphragm 53 has a uniform thickness to prevent undesired resonances.

It is preferable that the boundary portion between thin part 53C and thick part 53B gradually increase in thickness toward the outer periphery of diaphragm 53. More specifically, it is preferable that recess 53A have inclined surface 53D such that diaphragm 53 gradually increases in thickness from thin part 53C toward thick part 53B so as to enhance the strength of diaphragm 53. Furthermore, the surface between thin part 53C and inclined surface 53D is preferably chamfered or curved. This can reduce the stress concentration at the intersection of thin part 53C and inclined surface 53D, allowing diaphragm 53 to be stronger.

Inclined surface 53D may be linear, curved (such as arc-shaped), step-like, or of a combination thereof. The boundary portion between thin part 53C and thick part 53B does not necessarily have to have inclined surface 53D, and can alternatively be perpendicular to thin part 53C and parallel to thick part 53B.

The front side of diaphragm 53 is preferably flat, and diaphragm 53 may have a dust cap at its center.

Diaphragm 53 preferably has core material 53E made of foamed resin. This configuration allows diaphragm 53 to be lightweight, to have highly responsive properties, and hence, to provide quick sound rise. The configuration also improves the output sound pressure level of diaphragm 53 and extends the reproduction frequency range at high frequencies.

Diaphragm 53 may be composed of core material 53E alone, but preferably has reinforcement layer 53F as well.

Reinforcement layer 53F is preferably formed on both the front and rear sides of core material 53E so as to improve the strength of diaphragm 53. Reinforcement layer 53F is preferably made of rigid, lightweight material, such as carbon or metal like aluminum or titanium. This configuration allows diaphragm 53 to have a high speed of sound and a high sound pressure level. Reinforcement layer 53F may alternatively be formed on either the front side or the rear side of core material 53E, instead of being formed on both of them.

Reinforcement layer 53F may be formed by affixing a sheet-like reinforcement to core material 53E with an adhesive or the like. In the case that diaphragm 53 is circular, recess 53A is also circular when seen from behind, and inclined surface 53D is conical. When, however, the reinforcement is affixed to the conical inclined surface 53D, reinforcement layer 53F may be wrinkled. To avoid such wrinkles, it is preferable to form reinforcement layer 53F on both the rear side of thin part 53C and the rear side of thick part 53B. This also reduces the man-hours required to affix the reinforcement to the core material.

The strength of diaphragm 53 can be efficiently increased by increasing the strength of thin part 53C. Consequently, the reinforcement layer may be formed on either the rear side of recess 53A or the rear side of thin part 53C, thereby making diaphragm 53 lightweight.

Reinforcement layer 53F can be formed by methods other than the above-described affixing; for example, the reinforcement can be plated or sputtered on the surface of core material 53E.

Furthermore, the upper surface of magnetic circuit 61 is preferably located closer to the front side of diaphragm 53 than to the rear side of thick part 53B as shown in FIG. 3. In short, it is preferable that part of the magnetic circuit be located in recess 53A so as to allow loudspeaker 51 to have a thin profile.

Magnetic circuit 61 is preferably of internal magnet type so as to allow thin part 53C to have a small area, and hence, diaphragm 53 to have high strength. Magnetic circuit 61 of internal magnet type includes magnet 62, top plate 63, bottom plate 64, and yoke 65. Magnet 62 is columnar and is magnetized in the vertical thickness direction. Top plate 63 is planar and is placed on the upper surface of magnet 62. Bottom plate 64 has installation part 64A. Magnet 62 is placed on the upper surface of installation part 64A. Bottom plate 64 is magnetically connected to magnet 62. Yoke 65 extends upward from the outer peripheral end of the upper side of installation part 64A, and is magnetically connected to magnet 62 via bottom plate 64. Top plate 63, bottom plate 64, and yoke 65 are made of magnetic material, such as hot-rolled steel plates (for example, SPHC and SPHD).

In magnetic circuit 61, magnet 62 magnetizes top plate 63 and yoke 65 with opposite polarities. The inner peripheral surface of yoke 65 is located facing the outer peripheral surface of top plate 63 so as to form magnetic gap 56 therebetween as shown in FIG. 4. In the case that top plate 63 is magnetized with the north pole and that yoke 65 is magnetized with the south pole, the magnetic flux in magnetic gap 56 flows from top plate 63 to yoke 65.

It is preferable to form tapered part 65A on the outer peripheral surface of yoke 65. In other words, yoke 65 is preferably tapered from bottom plate 64 toward its tip. As a result, tapered part 65A, which tapers from the lower surface toward the upper surface, is formed on the outer peripheral surface of magnetic circuit 61. Tapered part 65A may be linear, curved (such as arc-shaped), step-like, or of a combination of them.

Inclined surface 53D of recess 53A is preferably located facing tapered part 65A so as to have the distance large enough to displace the amplitude of diaphragm 53 in the axial direction of the voice coil between tapered part 65A and inclined surface 53D, or in other words, between diaphragm 53 and magnetic circuit 61. This allows the upper surface of magnetic circuit 61 and the front side of diaphragm 53 to be located close to each other.

The region having inclined surface 53D is thicker than thin part 53C, so that diaphragm 53 can be stronger and less deformed in this region. This prevents inclined surface 53D from colliding with tapered part 65A regardless of the small distance between them. As a result, diaphragm 53 can be made thick in inclined surface 53D, and hence improved in strength.

Magnetic circuit 61 is preferably circular when seen from the front, and in this case, magnet 62 is preferably cylindrical. Top plate 63 is preferably disc-shaped, and in this case, diaphragm 53 is preferably either circular or oval when seen from the front.

Instead of being circular, magnetic circuit 61 may be oval or rectangular when seen from the front. In the case that magnetic circuit 61 is oval, bobbin 55A and top plate 63 are preferably oval when seen from the front, and diaphragm 53 is preferably either oval or rectangular when seen from the front. Meanwhile, in the case that magnetic circuit 61 is rectangular, bobbin 55A and diaphragm 53 are preferably rectangular when seen from the front.

Magnet 62 is preferably made of neodymium magnet because of its high energy product. This achieves a desired magnetic flux density in magnetic gap 56, allowing magnet 62 and hence the loudspeaker to have a thin profile.

Figure 9:
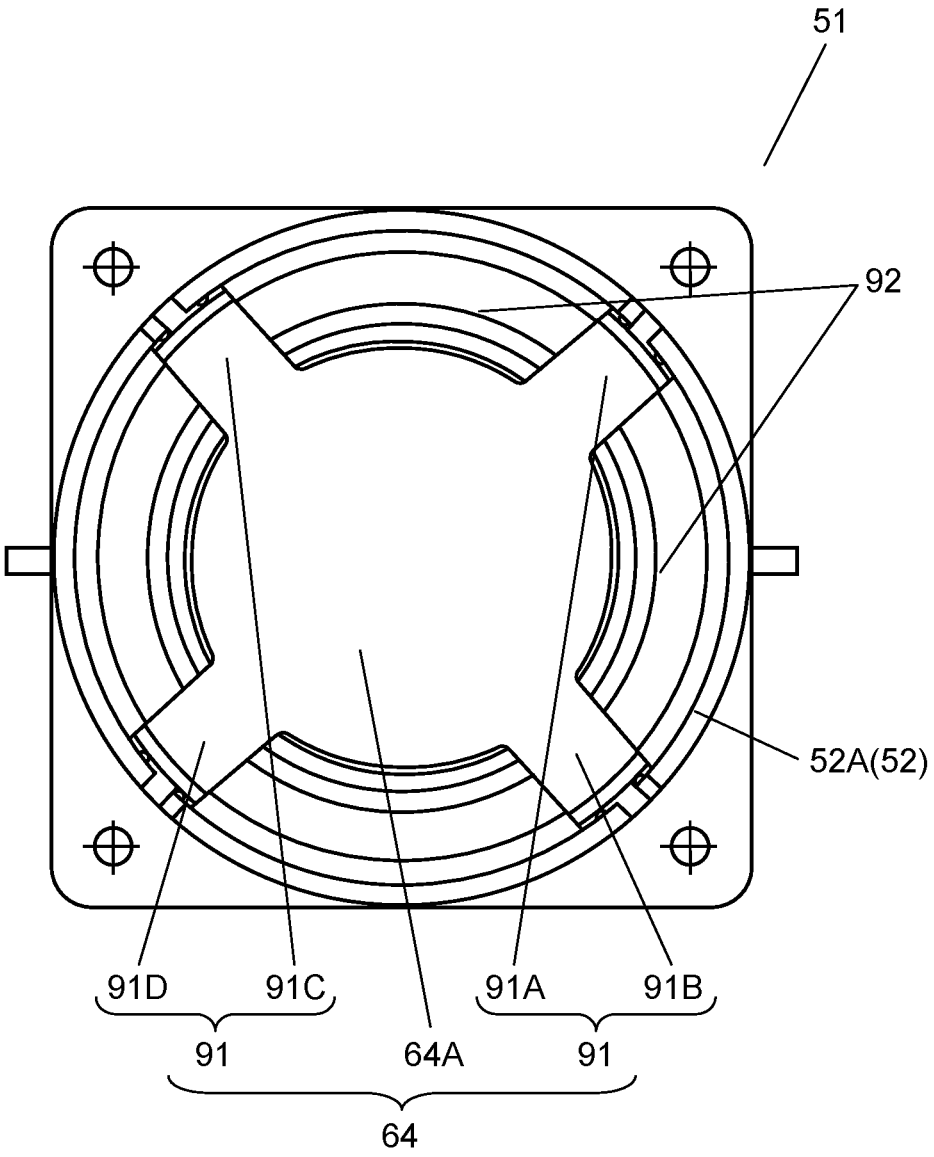
FIG. 9 is a rear view of the loudspeaker according to the present exemplary embodiment.

FIG. 9 is a rear view of loudspeaker 51. Bottom plate 64, which includes installation part 64A, preferably includes arms 91. Arms 91 extend from installation part 64A toward the outer periphery and are connected to frame 52. With this configuration, magnetic circuit 61 is connected to frame 52 via arms 91.

Bottom plate 64 preferably has a plurality of arms 91, and FIG. 9 shows four arms 91A-91D. Arms 91 are composed of arms 91A-91D extending in four directions perpendicular to each other. Each two adjacent arms 91 are separated by opening 92. Openings 92 allow diaphragm 53 to vibrate without being disturbed by the sound pressure (back pressure) from its rear side. Openings 92 also prevent the magnetic flux in magnetic circuit 61 from leaking to arms 91, thereby increasing the magnetic flux density in magnetic gap 56.

Installation part 64A and arms 91 are preferably integrally formed. This configuration makes it unnecessary to use a member for fixing magnetic circuit 61 to frame 52, thereby making bottom plate 64 thin and low cost. Alternatively, installation part 64A and arms 91 may be formed separately and combined together. In this case, it is preferable that installation part 64A be made of magnetic material, and that arms 91 be made of non-magnetic material. This configuration reduces magnetic field leakage to arms 91 and increases the magnetic flux density in magnetic gap 56.

Figure 10:
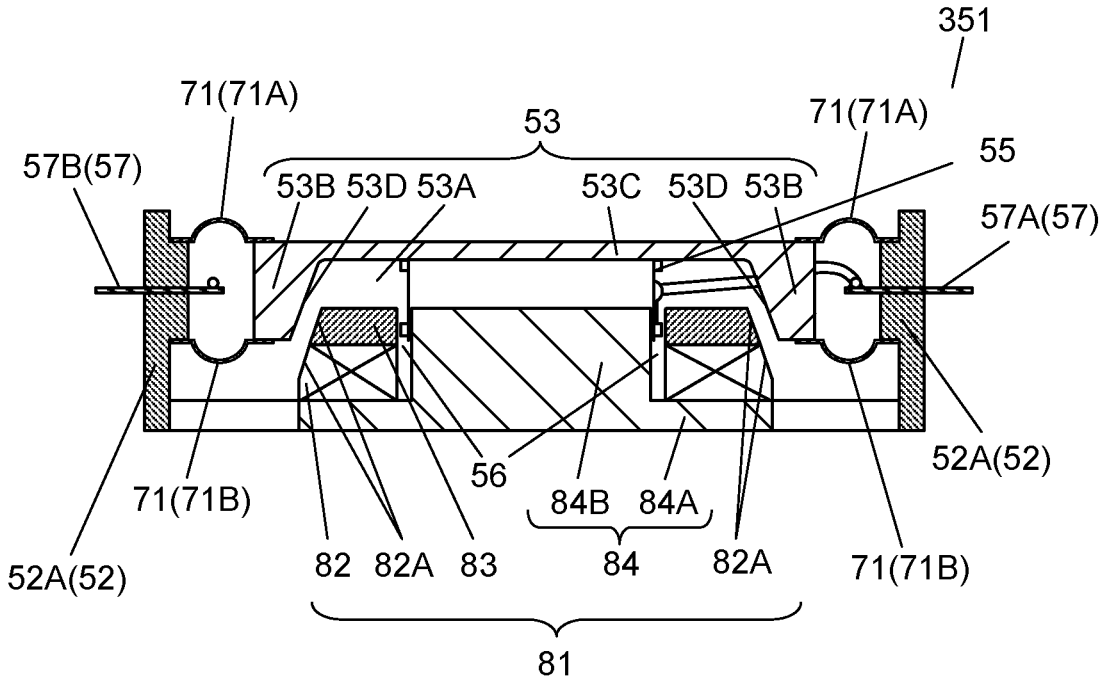
FIG. 10 is a sectional view of another loudspeaker according to the present exemplary embodiment.

Instead of being of the internal magnet type, magnetic circuit 61 of loudspeaker 51 may be of external magnet type or a combination of the internal and external magnet types. FIG. 10 is a sectional view of loudspeaker 351 according to the present exemplary embodiment. In loudspeaker 351, the same components as in loudspeaker 51 are denoted by the same reference numerals, and the description thereof will be omitted. In FIG. 10, magnetic circuit 81 has an inner part composed of center pole 84B, and an outer part composed of magnet 82 and top plate 83.

Loudspeaker 351 includes magnetic circuit 81 of external magnet type instead of magnetic circuit 61 of internal magnet type. Magnetic circuit 81 includes ring-shaped magnet 82, ring-shaped top plate 83, and bottom plate 84. Bottom plate 84 includes installation part 84A and center pole 84B. Center pole 84B extends upward from the center of installation part 84A. Magnet 82 is placed on the upper surface of installation part 84A, which is located outside center pole 84B. Top plate 83 is placed on the upper surface of magnet 82. The outer peripheral surface of center pole 84B is located facing the inner peripheral surface of top plate 83, and magnetic gap 56 is formed therebetween.

Similar to magnetic circuit 61, magnetic circuit 81 is located facing recess 53A. Thus, magnetic circuit 81 of external magnet type allows loudspeaker 51 to have a thin profile.

It is preferable that tapered part 82A be formed on the outer peripheral surface of top plate 83 and that tapered part 82A be located facing inclined surface 53D of recess 53A. Magnet 82 may be a bond magnet so as to be formed into a variety of shapes. Tapered part 82A is also preferably formed on the outer peripheral surface of magnet 82. Tapered part 82A and inclined surface 53D are preferably located facing each other.

Magnet 82 may be made of neodymium magnet, samarium iron magnet, ferrite magnet, etc., and may have a square cross section when made of these metals. In this case, recess 53A does not need to have inclined surface 53D.

Figure 11:
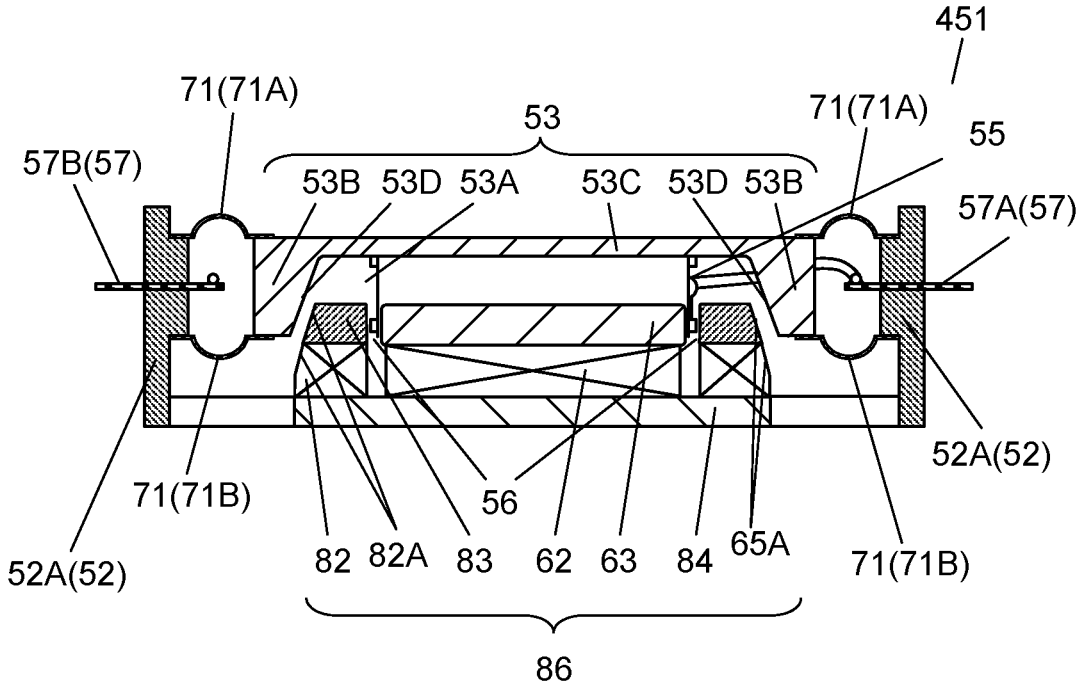
FIG. 11 is a sectional view of still another loudspeaker according to the present exemplary embodiment.

FIG. 11 is a sectional view of loudspeaker 451 according to the present exemplary embodiment. In loudspeaker 451, the same components as in loudspeakers 51 and 351 are denoted by the same reference numerals, and the description thereof will be omitted. In FIG. 11, magnetic circuit 86 has an inner part composed of magnet 62 (first magnet) and top plate 63 (first top plate), and an outer part composed of magnet 82 (second magnet) and top plate 83 (second top plate).

Loudspeaker 451 includes magnetic circuit 86 composed of a combination of the internal and external magnet types. Magnetic circuit 86 includes magnet 62 (first magnet) and top plate 63 (first top plate) instead of center pole 84B of magnetic circuit 81 shown in FIG. 10. Top plate 63 is placed on the upper surface of magnet 62. Magnet 62 and magnet 82 (second magnet) are placed on bottom plate 84 in such a manner as to be connected magnetically in series. Magnetic gap 56 is formed between the outer peripheral surface of top plate 63 and the inner peripheral surface of top plate 83 (second top plate). In this configuration, too, it is preferable that tapered part 82A be formed on the outer peripheral surface of top plate 83 and also be located facing inclined surface 53D of recess 53A. With this configuration, in spite that magnets 62 and 82 are thin, the magnetic flux density in magnetic gap 56 has at least the desired value, so that loudspeaker 51 can have a thin profile and a high sound pressure level.

Figure 12:
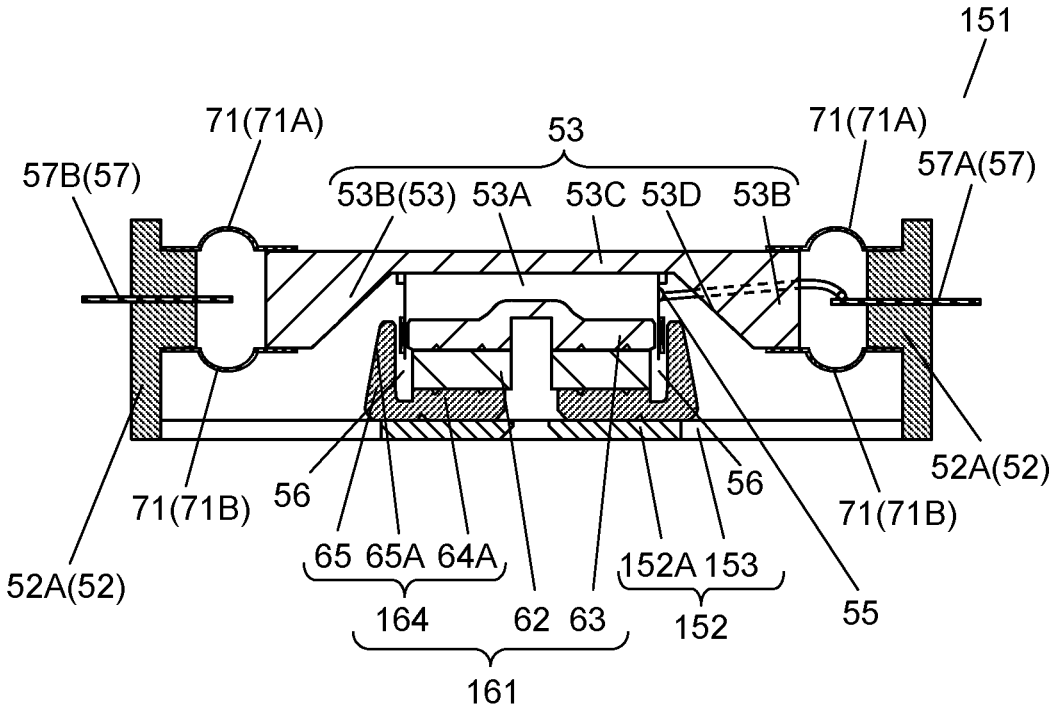
FIG. 12 is a sectional view of yet another loudspeaker according to the present exemplary embodiment.
Figure 13:
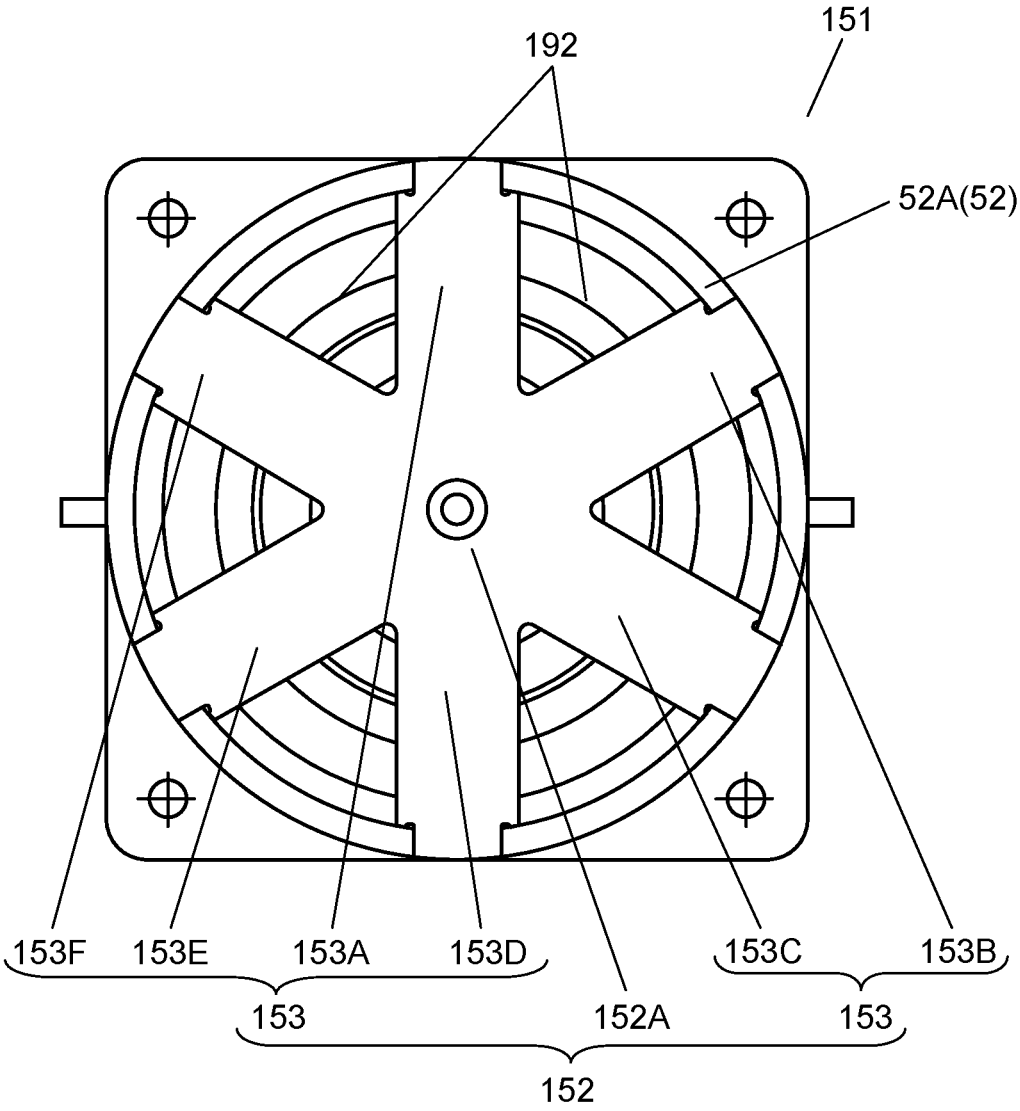
FIG. 13 is a rear view of the yet another loudspeaker according to the present exemplary embodiment.

FIG. 12 is a sectional view of loudspeaker 151 according to the present exemplary embodiment. FIG. 13 is a rear view of loudspeaker 151. In loudspeaker 151, the same components as in loudspeakers 51, 351, and 451 are denoted by the same reference numerals, and the description thereof will be omitted. Loudspeaker 151 includes magnetic circuit 161 and pedestal 152 instead of magnetic circuit 61 of loudspeaker 51. Pedestal 152 includes mounting part 152A and arms 153.

Magnetic circuit 161 includes magnet 62, top plate 63, and bottom plate 164. Bottom plate 164, which is a cylinder with a bottom, includes installation part 64A and yoke 65. Installation part 64A and yoke 65 are preferably integrally formed.

Mounting part 152A is formed in the center of pedestal 152. Magnetic circuit 161 is placed on the upper surface of mounting part 152A and is fixed to pedestal 152. The fixation may be achieved by screwing, bonding, or other methods.

The magnetic saturation of bottom plate 164 is likely to occur under the outer peripheral surface of magnet 62. For this reason, mounting part 152A is preferably made of magnetic material, such as hot-rolled steel plates (for example, SPHC and SPHD). As a result, mounting part 152A can function as a magnetic path in magnetic circuit 161. With this configuration, the magnetoresistance is small in the region under the outer peripheral surface of magnet 62, thereby achieving a low magnetic saturation of magnetic circuit 161 and a large magnetic flux density in magnetic gap 56.

Pedestal 152 includes arms 153 extending from mounting part 152A toward the outer periphery. The outer ends of arms 153 are fixed to frame 52 and, consequently, magnetic circuit 161 is fixed to frame 52. Mounting part 152A and arms 153 are preferably integrally formed, but may alternatively be formed separately and combined together. In this case, arms 153 are preferably made of non-magnetic material so as to prevent the magnetic flux in magnetic circuit 161 from leaking to arms 153.

It is possible to provide fixing claws, such as projections at the outer ends of arms 153, and in this case, frame 52 preferably has grooves, cutouts, or the like. The fixing claws can be fitted into the grooves, cutouts, or the like so that pedestal 152 can be fixed to frame 52.

Pedestal 152 preferably includes a plurality of arms 153 arranged at regular intervals. FIG. 13 shows six arms 153A-153F extending radially from mounting part 152A toward the outer periphery. Arms 153A-153F are preferably arranged at 60-degree intervals around the center of mounting part 152A.

It is further preferable to form opening 192 between two adjacent ones of arms 153A-153F so that diaphragm 53 can vibrate without being disturbed by the sound pressure (back pressure) from its rear side. Openings 192 also prevent the magnetic flux in magnetic circuit 161 from leaking to arms 153A-153F, and hence, increase the magnetic flux density in magnetic gap 56.

As described above, in the loudspeaker according to the present disclosure, the outer periphery of the diaphragm has a thick part thicker than the inner periphery, thereby ensuring the strength of the diaphragm. The diaphragm has, in the center of its rear side, a thin part thinner than the thick part, and the magnetic circuit is located facing the thin part. With this configuration, the distance can be small between the front side of the diaphragm and the upper surface of the magnetic circuit, so that the loudspeaker can have a thin profile while having a sufficient magnetic flux density in the magnetic gap. As a result, the thin loudspeaker has a high sound pressure level and causes less distortion.

Figure 14:
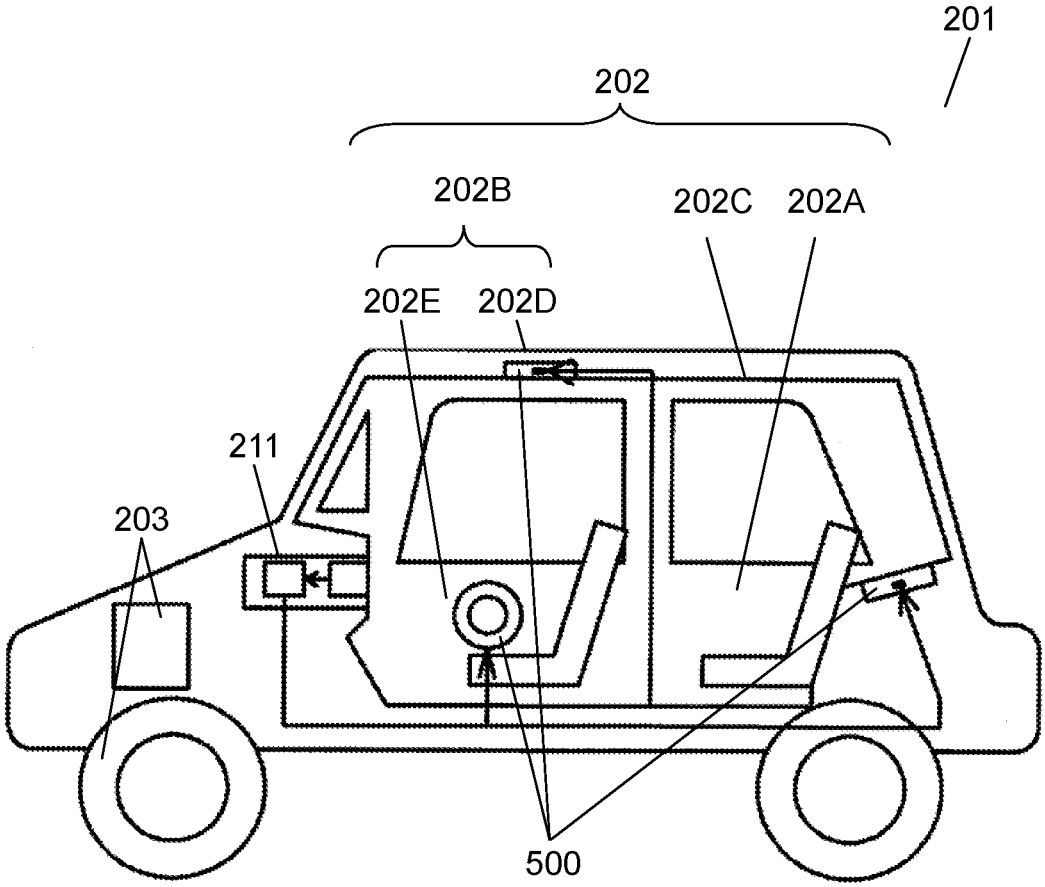
FIG. 14 is a conceptual view of a mobile device according to the present exemplary embodiment.

FIG. 14 is a conceptual view of mobile device 201 according to the present exemplary embodiment. Mobile device 201 is equipped with loudspeaker 500. Loudspeaker 500 represents one of loudspeakers 51, 151, 351, and 451 according to the present exemplary embodiment. In FIG. 14, mobile device 201 is an automobile, but may be other vehicles such as ships, airplanes, trains, and motorcycles.

Mobile device 201 includes body 202, drive part 203, amplifier 211, and loudspeaker 500. Drive part 203, amplifier 211, and loudspeaker 500 are mounted in body 202. Drive part 203 may include an engine, a motor, tires, a steering wheel, and other parts. The output of amplifier 211 is supplied to loudspeaker 500. Amplifier 211 may include part of a car audio system, and additionally include a sound reproducing device. Also, amplifier 211 may include part of a car navigation system, and additionally include a display device.

Body 202 includes passenger space 202A. Loudspeaker 500 is placed to deliver sound to passenger space 202A. Body 202 may further include exterior part 202B and interior part 202C. Exterior part 202B, which isolates passenger space 202A from the outside, can be, for example, roof 202D or door 202E. Interior part 202C is located between exterior part 202B and passenger space 202A. Loudspeaker 500 is placed between interior part 202C and exterior part 202B, but may alternatively be placed in a dashboard, a rear tray (not shown), or other places.

Loudspeaker 500 of the present exemplary embodiment has a thin profile and therefore can have a small distance between interior part 202C and exterior part 202B. In other words, loudspeaker 500 can be placed even if the distance is small between interior and exterior parts 202C and 202B. Thus, the use of loudspeaker 500 as mobile device 201 expands passenger space 202A.

The above-described exemplary embodiment is an example to facilitate the understanding of the present invention and does not limit the invention thereto. The materials and shapes of the components of loudspeaker 500 described in the exemplary embodiment can be variously modified.

The present invention, without departing from the spirit thereof, may be modified or improved and may include equivalents thereof.

INDUSTRIAL APPLICABILITY

The loudspeaker of the present disclosure has a thin profile and is therefore suitable for use especially in in-car audio systems and home audio systems.

The invention claimed is:

1. A loudspeaker comprising:

a frame having a hollow;

a diaphragm located in the hollow of the frame and having:

a first side as a surface of a recess defined by a thin part and a thick part formed around the thin part; and a second side opposite to the first side;

a first edge connecting an outer peripheral end of the diaphragm and the frame;

a second edge connecting the outer peripheral end of the diaphragm and the frame, the second edge being opposite to the first edge with respect to a center in a thickness direction of the thick part;

a voice coil body including:

a cylindrical bobbin having a first end connected to the thin part on the first side of the diaphragm and a second end opposite to the first end; and a voice coil wound around at least part of the bobbin; and a magnetic circuit including:

an inner part; and an outer part formed around the inner part with a magnetic gap therebetween, wherein part of the magnetic circuit including a first side of the inner part is located from the second end of the bobbin into the bobbin, and the first side of the inner part and a first side of the outer part are located in the recess so that the voice coil is located in the magnetic gap.

2. The loudspeaker of claim 1, wherein the outer part of the magnetic circuit has a tapered part tapering toward the diaphragm.

3. The loudspeaker of claim 1, wherein the diaphragm has an inclined surface such that the diaphragm gradually increases in thickness from the thin part toward the thick part.

4. The loudspeaker of claim 3, wherein the outer part of the magnetic circuit has a tapered part tapering toward the diaphragm, the tapered part being located facing the inclined surface.

5. The loudspeaker of claim 1, wherein the first edge and the second edge are located symmetrically with respect to a plane perpendicular to a vibration direction of the diaphragm.

6. The loudspeaker of claim 1, wherein the second side of the diaphragm is flat.

7. The loudspeaker of claim 1, wherein the diaphragm is made of foamed resin and has a reinforcement layer on at least one of the first side and the second side of the diaphragm.

8. The loudspeaker of claim 1, further comprising:

a terminal fixed to the frame and located between the first edge and the second edge; and a connecting wire connecting the terminal and the voice coil.

9. The loudspeaker of claim 1, further comprising a pedestal fixing the magnetic circuit to the frame.

10. The loudspeaker of claim 9, wherein the pedestal has an opening.

11. The loudspeaker of claim 1, wherein the magnetic circuit includes:

a magnet;

a top plate placed on a first side of the magnet;

a bottom plate placed on a second side of the magnet opposite to the first side and magnetically connected to the magnet; and a yoke placed around the top plate and facing the top plate with the magnetic gap therebetween, the yoke being magnetically connected to the magnet via the bottom plate, wherein the inner part of the magnetic circuit is composed of the magnet and the top plate; and the outer part of the magnetic circuit is composed of the yoke.

12. The loudspeaker of claim 11, wherein the bottom plate has an opening.

13. The loudspeaker of claim 1, wherein the magnetic circuit includes:

a ring-shaped magnet;

a ring-shaped top plate placed on a first side of the magnet;

a bottom plate placed on a second side of the magnet opposite to the first side and magnetically connected to the magnet; and a center pole located in the magnet and facing the magnet with the magnetic gap therebetween, the center pole projecting from the bottom plate, wherein the inner part of the magnetic circuit is composed of the center pole; and the outer part of the magnetic circuit is composed of the magnet and the top plate.

14. The loudspeaker of claim 1, wherein the magnetic circuit includes:

a first magnet;

a first top plate placed on a first side of the first magnet;

a bottom plate placed on a second side of the first magnet opposite to the first side and magnetically connected to the first magnet;

a second magnet placed around the first magnet and facing the first magnet with the magnetic gap therebetween; and a second top plate placed on a first side of the second magnet and around the first top plate, the second top plate facing the first top plate with the magnetic gap therebetween, wherein the inner part of the magnetic circuit is composed of the first magnet and the first top plate; and the outer part of the magnetic circuit is composed of the second magnet and the second top plate.

15. A mobile device comprising:

a body;

a drive part mounted in the body;

an amplifier mounted in the body; and the loudspeaker of claim 1 receiving an output of the amplifier.

16. The mobile device of claim 15, wherein the body includes:

an interior part; and an exterior part covering an outer periphery of the interior part with a predetermined space from the interior part, and the loudspeaker is located in the space.

17. The mobile device of claim 16, wherein the exterior part is either a door or a roof.

* * * * *